US005452640A

United States Patent [19]

Bovee et al.

[11] Patent Number: 5,452,640

[45] Date of Patent: Sep. 26, 1995

[54] MULTIPURPOSE LAUNCHER AND CONTROLS

[75] Inventors: Stan P. Bovee, St. Cloud; David R. Boudreau, Brooklyn Park, both of Minn.

[73] Assignee: FMC Corporation, Chicago, Ill.

[21] Appl. No.: 57,391

[22] Filed: May 6, 1993

[51] Int. Cl.[6] ..... F41F 3/04

[52] U.S. Cl. ..... 89/1.815; 89/1.816

[58] Field of Search ..... 89/1.815, 1.816, 89/1.8, 1.35; 102/505

[56] References Cited

U.S. PATENT DOCUMENTS

| | | | |
|---|---|---|---|
| 2,866,384 | 12/1958 | Hersh | 89/1.815 |
| 3,106,132 | 10/1963 | Biermann et al. | 89/1.815 |
| 3,865,009 | 2/1975 | Kongelbeck | 89/1.815 |
| 3,943,870 | 3/1976 | Paslay | 89/1.815 |
| 4,063,485 | 12/1977 | Carter et al. | 89/1.816 |
| 4,222,306 | 9/1980 | Maury | 102/505 |
| 4,305,325 | 12/1981 | Lange et al. | 89/1.816 |
| 5,020,412 | 6/1991 | Adams | 89/1.815 |
| 5,129,307 | 7/1992 | Cain et al. | 89/1.815 |
| 5,269,214 | 12/1993 | Badura et al. | 89/1.816 |

*Primary Examiner*—Charles T. Jordan

*Attorney, Agent, or Firm*—G. Wolde-Michael; R. C. Kamp; R. L. Andersen

[57] ABSTRACT

The multipurpose launcher and controls disclosed herein relates to a modular, expandable system with several operational and combat mission options for surface ships. Particularly, the system enables growth in both structure and controls to enable a staged build up, an upgrade or a turnkey system which can launch different types of missiles, rockets, chaff and decoy. More particularly, the system's modularity in both structure and controls enables it to adopt to a variety of existing and future mission requirements. The multipurpose launcher provides trainability and pointing capability for optimal area coverage and for ordnance requiring precise target placement. The system is reconfigurable and modular to obtain a desired ship class mission capability.

7 Claims, 5 Drawing Sheets

MULTIPURPOSE LAUNCHER AND CONTROLS

FIELD OF THE INVENTION

This invention relates to Multipurpose launchers and controls which provide flexibility to handle various types of chaff, rocket and missiles differing in geometry, size, fly-out characteristics and mission. One of the significant advances made in this invention include modularity in both hardware and control systems to adopt to desired mission requirements. Further, the multipurpose launchers and controls enable pointing capability, inventory control and adaptability to many modem ship logistics to compose an integral part of general and specific air threat combat systems.

SUMMARY OF THE INVENTION

The Multi-purpose launcher and controls of the present invention include a trainable and elevatable launcher that can fire existing chaff, decoy rounds as well as a variety of other weapons including missiles and rockets. Particularly, the present invention is modular and provides expandability in structure and controls which endow it with a superior feature to adopt to a variety of existing and future mission requirements.

Specific advances, features and advantages of the present invention will become apparent upon examination of the following description and drawings dealing with several specific embodiments thereof.

DESCRIPTION OF THE PREFERRED EMBODIMENTS

Figure 2:
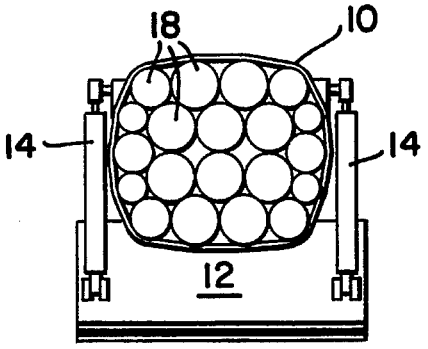
FIG. 2 is a front elevation view of FIG. 1 with the multiple launcher in a stowed position.
Figure 1:
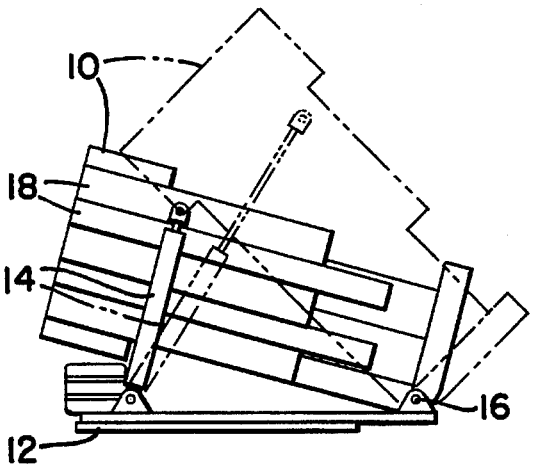
FIG. 1 is an elevation side-view of multiple launcher in a stowed and extended ( phantom lines) positions.

An embodiment of the Multi-purpose launcher is shown in FIGS. 1–2. FIG. 1 is an elevation side view of a multiple launcher in a stowed and extended (phantom lines) positions. Trainable/elevatable box launcher 10 is attached to rotatable platform 12 by means of pistons 14 and hinges 16. Launch tube clusters 18 having varying diameters are disposed in box launcher 10.

Figure 3:
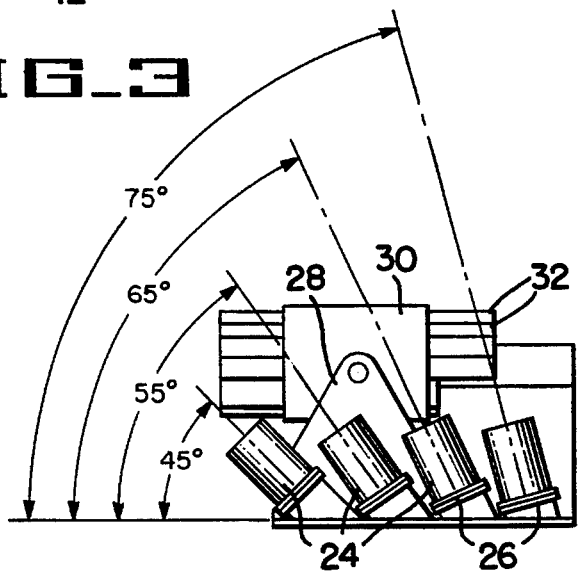
FIG. 3 is an elevation side view of another embodiment of a multiple launcher with fixed tube launchers oriented at different angles of inclination.
Figure 4:
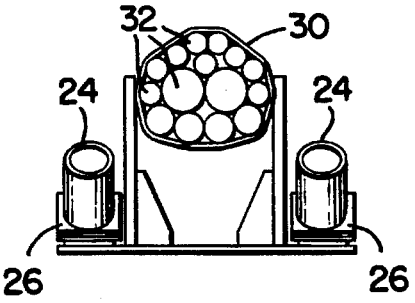
FIG. 4 is a front elevation view of FIG. 3.

Another embodiment is disclosed in FIGS. 3–4. FIG. 3 is an elevation side view of a multi-purpose launcher. Particularly, inclined decoy/chaff launchers 24 are disposed on side mount 26 at predetermined angles of inclination. Elevation/support mechanism 28 provides support and elevation adjustment for multi-sided launcher housing 30. Launcher housing 30 contains a plurality of launch tube clusters 32.

Figure 5:
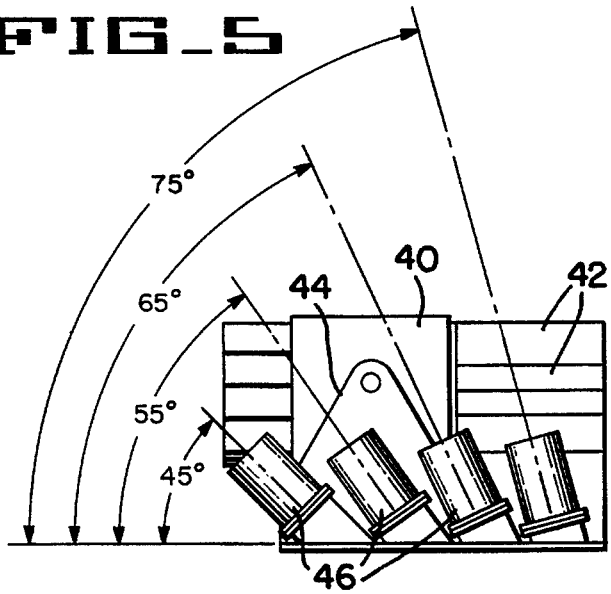
FIG. 5 is a side elevation view of yet another embodiment of a multiple launcher with fixed tube launcher arrangements disposed on one side of the launcher.
Figure 6:
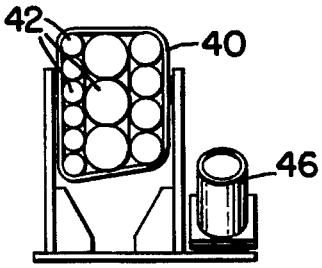
FIG. 6 is a front elevation view of FIG. 5.

Yet another embodiment is disclosed in FIGS. 5–6. FIG. 5 is an elevation side view of a multi-purpose launcher with a series of chaff/decoy launchers disposed on one side. A four sided launcher housing 40 contains launcher tubes 42. Four sided launcher housing 40 is supported by elevatable/trainable support 44. An arrangement of a series of chaff/decoy launchers 46 is disposed on one side of four sided launcher housing 40.

Figure 7:
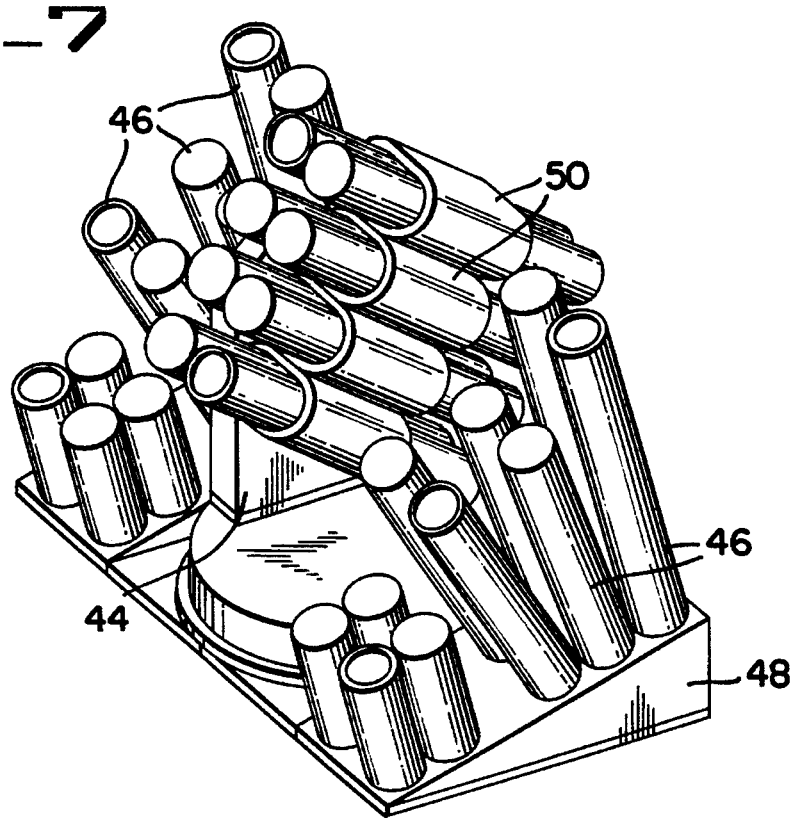
FIG. 7 is a perspective view of a trainable and elevatable launcher with variable size launch tubes at the side mounted on a fixed base.
Figure 8:
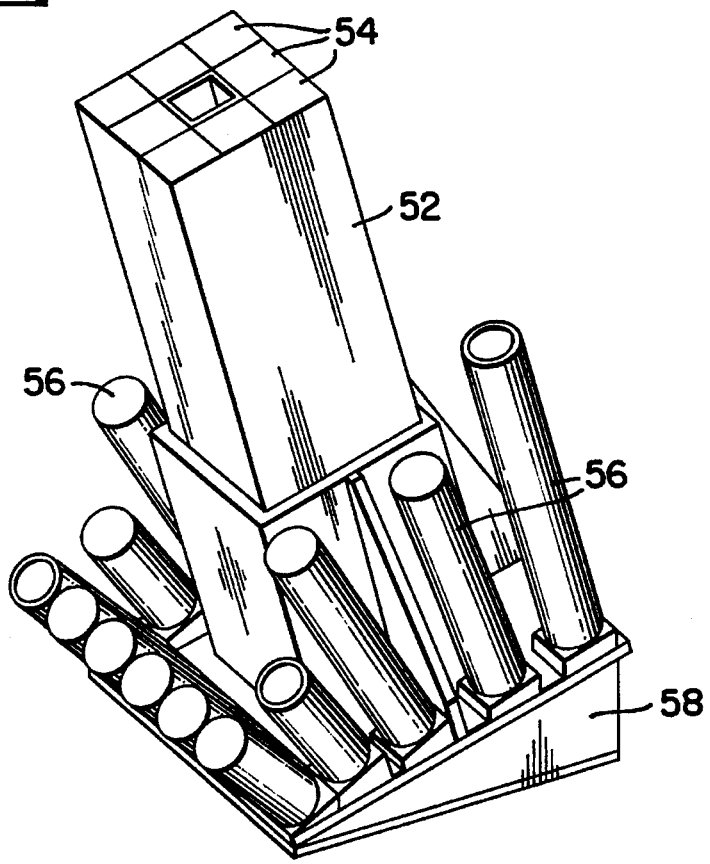
FIG. 8 is a perspective view of a trainable cluster of rectangular launcher with variable size tubular launchers mounted on a fixed base and disposed on three sides of a rectangular base assembly.

Another embodiment is disclosed in FIGS. 7–8. FIG. 7 is a perspective view of a trainable and elevatable launcher. Inclined array of decoy/chaff launchers 46 are mounted on a platform 48. Further, bundled launchers 50 are mounted on an elevatable/trainable support 44. Inclined array 46 comprise a variety of launcher sizes inclined at different angles.

Similarly, FIG. 8 depicts a fixed box launcher 52 having box compartments 54. Inclined array of launcher tubes 56 are arranged on three sides of support platform 58.

Figure 9:
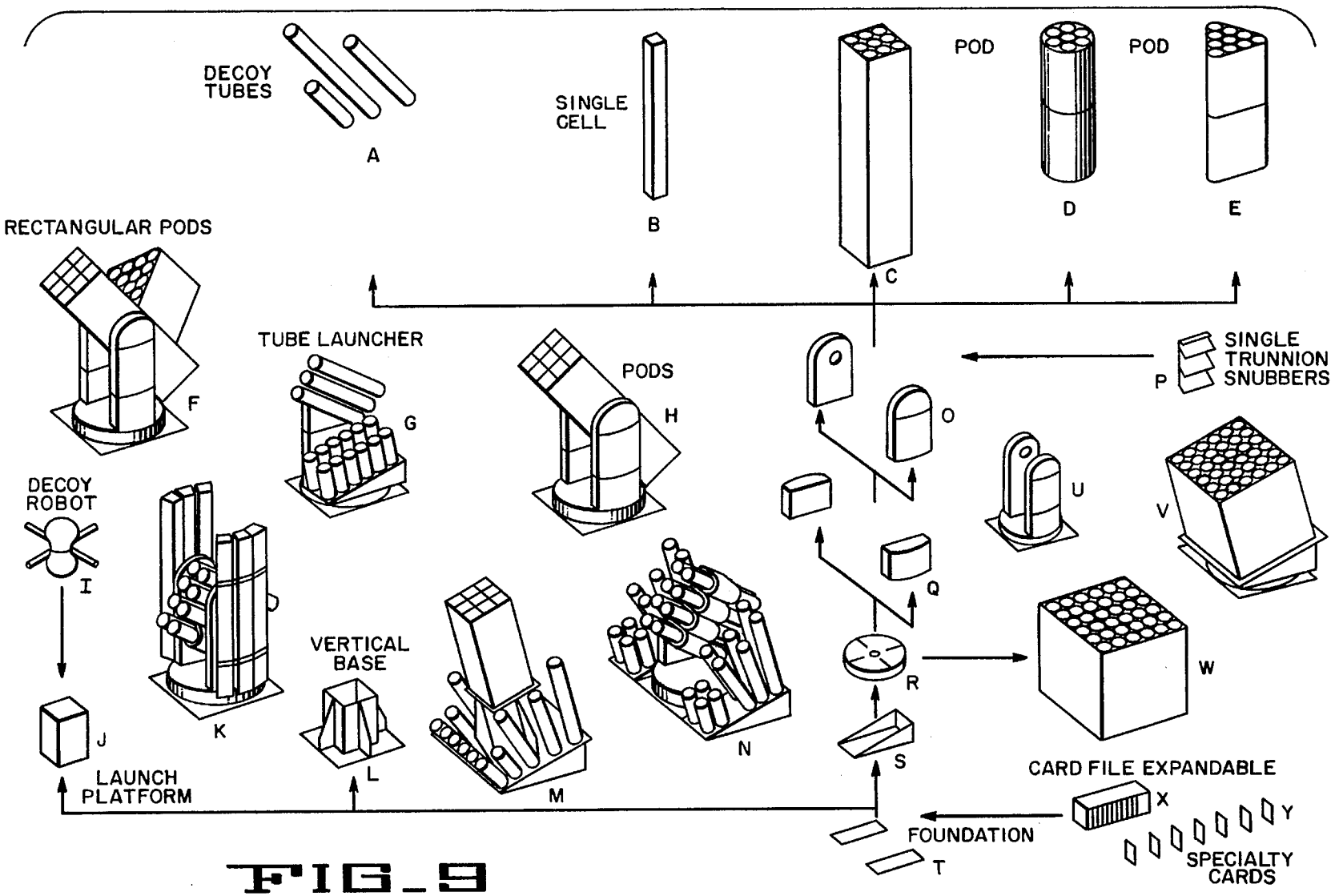
FIG. 9 is a parts, components and systems perspective view depicting the interchangeability, modularity and expandability of components and systems. Components and systems are designated by the letters A through Y in alphabetical order as shown, and are identified and discussed hereinbelow.

FIG. 9 is a compilation showing the modular and expandable features of the present invention. It provides some of the variations in structure, design as well as different combinations to accommodate application requirements. The designated structures include: A—DECOY TUBES: launch tubes of varying lengths and diameters to house countermeasure rounds (decoys) for use in distraction or deception; B—SINGLE CELL: Launch tubes of varying lengths with square or rectangular shaped cross sections to house countermeasure rounds (decoys) for use in distraction or deception; C—A grouping of launch tubes in a square or rectangle box or pod to house various rounds; D—A grouping of launch tubes in a circular box or pod to house various rounds; E—A grouping of launch tubes in a triangular box or pod to house various rounds; F—Rectangular pods, depicting a launcher made of various pods, in this case rectangular and triangular pods, on a trainable and elevatable launch form; G—Tube launcher, a launcher comprising circular launch tubes on a trainable and elevatable launch platform, the shorter circular tubes are fixed at an angle and do not elevate; H—Pods, A launcher comprising square launch tubes on a trainable and elevatable launch platform; I—Decoy robot, an air vehicle decoy round used in seduction or deception mode of operation, having a larger diameter than can fit in a standard launch tube; J—Launch platform, A canister, platform or launch tube for launching of decoy robots; K—A launcher comprising circular and square launch tubes on a trainable and elevatable launch platform, the square tubes are fixed in a vertical position; L—Vertical base, a fixed base for housing a square rectangular launch pod, the base can be fixed vertically or at a fixed angle and mounted to a trainable platform; M—A launcher comprising round fixed angled launch tubes with a square fixed angled launch pod; N—A launcher comprising circular launch tubes, some at fixed angles and some mounted to an elevatable arm, the center assembly trains and elevates and the outer two sets of launch tubes are fixed at certain angles; O—Elevation trunnions for support of various launch tube pod configurations; P—Single turnings snobbers, a rack for mounting circular launch tubes to a trunnions support; Q—Elevation Turin extension(s) for use in obtaining clearance for various pod or launch tube configurations; R—Train platform for use with various launcher configurations where rotation is desired; S—Fixed angle base or platform for attaching fixed angle launch tubes or pods to the main launcher structure; T—Foundation, a base support for interfacing with the ship structure or deck, the launcher is attached to the structure and bolted to the ship; U—A pair of trunnions support structures mounted on a trainable platform; V—A launcher comprising a fixed angle square launch pod mounted on a trainable base; W—A square launch pod with a number of launch tubes located within; X—Card file expandable, A launcher control system that is modular in nature and can be reconfigurable easily by adding or removing electrical specialty circuit cards that provide functions for each selected launcher function (i.e. train, elevate, etc.); Y—Specialty cards, circuit cards that provide selected launcher functions such as train and elevation as well as an interface for a variety of rounds integrated into each launching system.

Figure 10:
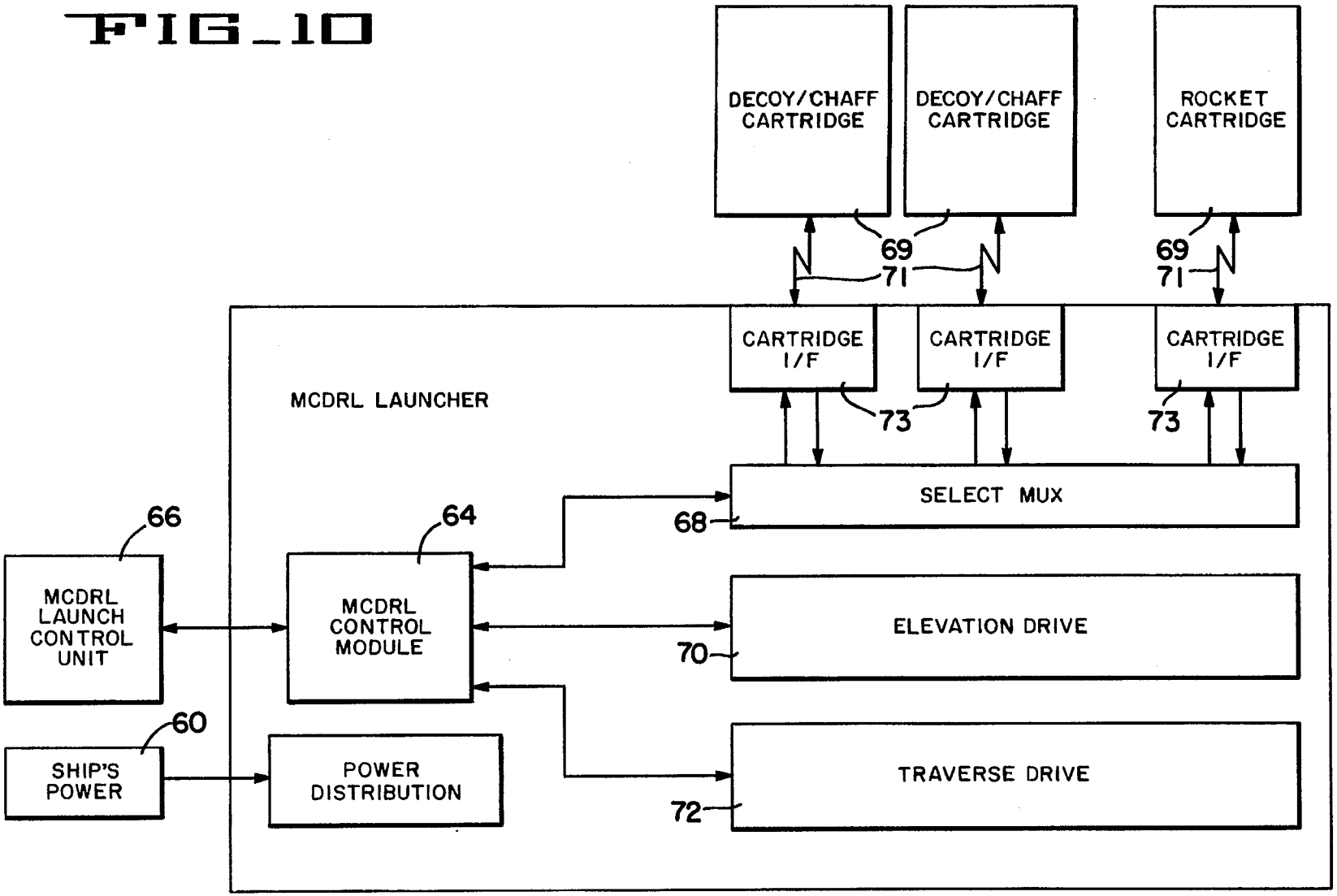
FIGS. 10, 11 and 12 are system architecture block diagrams for the multi-purpose launcher controls and system interface.
Figure 11:
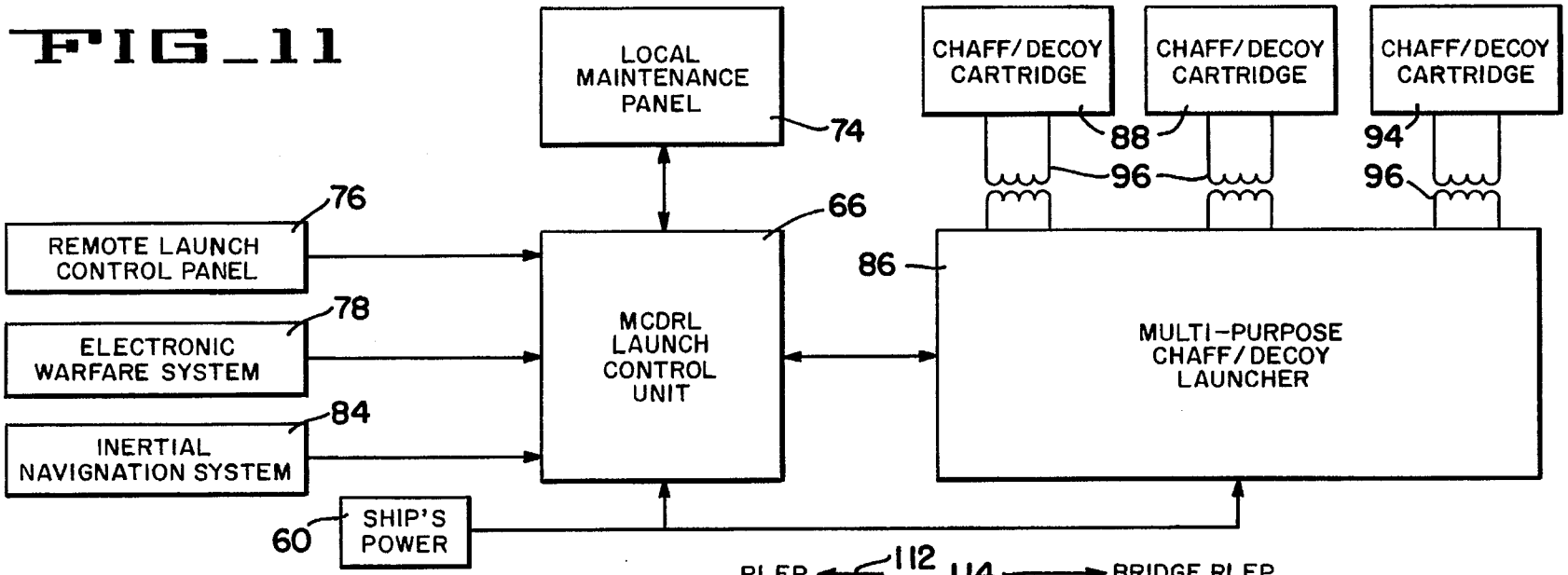
Figure 12:
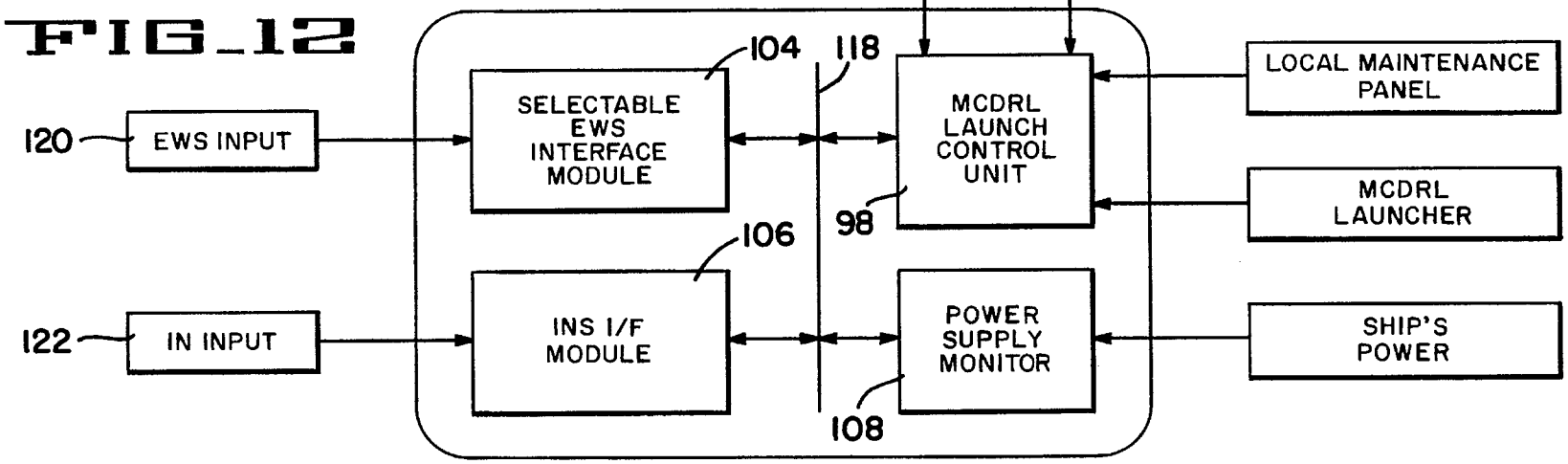

FIGS. 10–12 depict the electrical system architecture for the present invention. The electrical system architecture is compatible with the essence of the invention which enables adaptability to a variety of existing and future mission requirements. The electrical and control systems and its architecture are discussed in detail hereinbelow in conjunction with the operations of the multi-purpose launcher systems.

Referring now to FIGS. 1–2, a trainable/elevatable box launcher 10 is shown connected to rotatable platform 12. Particularly, pistons 14 are connected to launcher 10 and platform 12. Further, hinge 16 provides connection between launcher 10 and platform 12. Accordingly, when pistons 14 are extended, launcher 10 is elevated. Further, the system becomes trainable when platform 12 is rotated. Thus, the present invention provides a pointing capability by elevating launcher 10 and enables pointing in a selected direction by rotating platform 12. These features provide optimum area coverage and can accommodate ordinance which requires more precise target placement before deployment. Launch tube clusters 18 which comprise a variety of rounds enable the system to provide multipurpose functions. Some of these functions include the use of launcher 10 to house rockets, missiles, chaff and decoy for ship self-defense.

The train and elevation mechanism (not shown) include electric drives which are not presently utilized on navy pointing launchers. The electric drives to train or elevate are the same type motors with step functions to perform training and elevation as apparent. The control system and electronics package will be compatible with the system architecture shown in FIG. 10. Power is supplied from ship's power distribution system. A typical Multi-Purpose Chaff/Decoy and Rocket Launcher (MCDRL) system comprises an MCDRL control module 64, having a two-way connection with MCDRL launch control unit 66. MCDRL control module 64 is provided with a two-way connection to a circuit for a multiplex (SELECT MUX) 68 operation which includes a switching mechanism and selecting/monitoring mechanism for the type of ordnance to be used. SELECT MUX 68 enables selection among a variety of ordnance to be used. For example, in a system comprising chaff/decoy, rocket or a number of different sizes and types of ordnance, selection can be made as to which weapon to use. Further, inventory control can be implemented to monitor and replenish weapons as needed. MCDRL control module 64 includes connections to elevation 70 and traverse 72 drive options to accommodate systems which include these features. Particularly, the select MUX 68 module is connected to cartridges 69, which include decoy/chaff and rocket cartridges. Intermediate connectors 71 are directly connected to cartridge I/F (Interface) 73. I/F 73 are in turn connected to Select MUX 68. Accordingly, MCDRL launcher control module 64 is modular in design and provides light weight, low cost and small size and can be tailored to platform needs.

FIG. 11 depicts a launch control unit of the MCDRL electrical system architecture. The unit includes a local maintenance panel having a two-way communication with MCDRL launch control unit 66. Local maintenance panel 74 provides confirmation commands, status and power within the system, and communicates this information to launch control unit 66. Further, remote launch control panel(s) 76, which is essentially a CIC (command and information center) and bridge, is connected to MCDRL launch control unit 66. Electronic warfare system(EWS) 78 is also connected to MCDRL launch control unit 66. Inertial navigation system (INS) 84 is also connected to MCDRL launch control unit 66 and provides an optional feature. Furthermore, MCDRL Launch Control Unit 66 is connected to Multipurpose chaff/decoy Launcher 86. Multipurpose Launcher 86 is also connected to chaff/decoy cartridges 88 and rocket cartridge 94. Connectors 96 include unique interface (I/F) elements with non-contact surface which provide power transmission from Ships power 60 to canisters containing chaff/decoy cartridges 88 or rocket cartridge 94. Particularly, connectors 96 are designed to overcome unreliable connection between electrical systems due to a ship's environment which is highly corrosive. Connectors 96 comprise a non-contact surface. A transformer generates an electromagnetic field across a separation space to thereby transmit electric current and eliminates undesirable surface contacts. The MCDRL electrical system provides an improved support system in an overall ship defense system comprising hardkill and softkill missions. It is sufficiently flexible to provide a multi-mission capability and is cost effective with a light weight design. As indicated hereinabove, the system is modular and can meet the requirements for different launcher systems and platforms.

FIG. 12 is a detail of MCDRL Launch Control Unit (LCU) 98. It comprises selectable EWS Interface (I/F) module 104, INS I/F module 106, and Power Supply/Monitor module 108. Further, a CIC (Command Information and Control) Remote Launch Enable Panel (RLEP) 112 is connected to LCU 98. A bridge RLEP 114 is also connected to LCU 98. Selectable EWS I/F Module 104 as well as INS I/F module (optional) 106 are connected to LCU 98 via backplane bus 118. Selectable EWS I/F 104 is directly connected to EWS input 120 and INS I/F module 106 is directly connected to INS input 122. MCDRL LCU 98 includes a user configurable input/output and a high performance low cost CPU. These features enable the utilization of off-the-shelf modules with low cost and small size advantages.

An exemplary operational sequence may be reviewed in conjunction with the embodiment shown in FIG. 4. As discussed hereinabove, FIG. 4 is an embodiment of a multiple launcher with fixed tube launchers and an elevatable launcher consisting varying size rocket/missile rounds. As shown in FIG. 4, inclined decoy/chaff launchers 24 are removably mounted on side mount 26. Launchers 24 are inclined relative to one another as shown. Side mount 26 is removable and adaptable to the size and structural requirements of launchers 24. Moreover, unlike prior practice, the present invention enables the refurbishment and unlimited re-use of launchers 24. More particularly, the present invention enables a configuration in which different sizes and dimensions of launchers 24 may be assembled and installed on side mount 26 to meet mission requirements.

When a fire command is issued by the user, MCDRL Launch Control Unit 66 is activated (Refer to FIG. 10). The message is passed to MCDRL control module 64. Hereafter, the Select MUX 68, Elevation drive module 70 and traverse drive module 72 are activated. Particularly, Elevation 70 and traverse 72 drives are activated to receive user instructions and to respond accordingly. More particularly, the user may choose which decoy/cartridge to fire by selecting the type of ordinance, for example rocket cartridge 69. This selection is made possible by Select MUX 68 unit , which is directly connected to cartridge I/F 73.

More specifically, with reference to FIG. 11, Remote Launch control panel 76 is activated and launch control command is sent to MCDRL launch control unit 66. Further, if electronic warfare is anticipated or this option exercised, Electronic Warfare System (EWS)78 is activated and Launch Commands such as status, loadout and attitude data are sent to MCDRL launch control unit 66. Similarly, Inertial Navigation System (INS) 84 option may be exercised if navigation and attitude data is required to be entered into the MCDRL launch control unit 66. A fire and position loadout status is communicated between MCDRL control unit 66 and Multi-Purpose Chaff/Decoy/Rocket Launcher-(MCDRL) 86. From MCDRL 86, the fire command as issued by the user is transmitted to the Cartridge of choice, i.e., Chaff/Decoy Cartridge 88 or Rocket cartridge 88. The choice of which one to fire is noted and isolated to be directed to the proper cartridge by means of fire commands (CMDS) identification connections 96. A local maintenance panel 74 is used to feed back MCDRL launch control unit 66. For example, status and power conditions are fed back to MCDRL launch control unit 66 via a connections which confirms an original command as issued by the user. Accordingly, a simultaneous selection can be made to fire chaff/Decoy cartridge in launcher 24 while at the same time choosing to fire any one of tube clusters 32 in launcher housing 30. Further, Launcher housing 30 may be elevated and/or traversally driven to orient the rockets or missiles in launch tube clusters 32 as needed while at the same time selection and firing of Chaff/decoy cartridges in tube 24 is executed.

FIG. 9 depicts a number of parts and systems of the present invention. Designation A shows different sizes of decoy tubes which are used to launch different types of decoys/chaff. The tubes may be mounted on a fixed platform or a trainable platform. Designation B shows a single cell housing canister. In contrast Designations C, D and E show Pods in which a variety of launch tubes are stored to provide multiple storage and containment. Designation F shows a trainable/elevatable rectangular pods. One of the launcher housings includes a number of single cell launch tubes which contain rockets or missiles. Another rectangular box is installed piggy-back containing tube launchers which may be used to launch decoys/chaff. Designation G shows trunnion mounted tube launchers as well as fixed angle base-mounted decoy tube launchers. This arrangement enables the training of the tube launchers to deploy ordinance which may require more precise target placement. Designation H shows a variation of the embodiment in Designation F, wherein the piggyback launcher is omitted. Designation I shows exemplary decoy robot, in a deployed position, with stabilizer fins extended. During storage, the fins are folded inside a launch tube. A launch platform is shown in Designation J, from which a decoy robot of the type shown in Designation I may be launched.

Designation K shows a variation of Designations F, G and H with a trainable/elevatable set of launch tubes. Particularly, the configuration in Designation K provides protection for the launcher tubes by means of an extended trunnion.

Designation L shows a vertical base having a rectangular cross-section with gusset plates as stiffeners for the sides.

Designations M and N show different types of arrangements in which decoy tubes and launchers are arranged to meet specific mission requirements.

Designations O, P, Q, R, S, T, U depict piece parts which provide training and elevation of a launch system. A typical system may include a foundation which is attached to a fixed angle base or a training mechanism. Further, a typical system may include a trunnion with or without an extension. Multi-pack launchers such as the ones shown in Designations V and W may be supported on a fixed angle base or a training mechanism as required.

Designations X and Y depicts cards which can be used to control the MCDRL launch control functions which monitor the cooperation and operation of the different components. The card file is expendable to accommodate special features and controls as dictated by mission requirements.

Accordingly, as Shown in FIG. 9, the present invention provides modularity and expandability to meet a variety of mission requirements and specifications. The modularity in packaging and design enables options to add future expansions. Thus, a chaff/decoy launcher may be upgraded to include launchers for missiles and rockets by making minimum changes to the existing system.

While a preferred embodiment of the present invention has been shown arid described herein, it will be appreciated that various changes and modifications may be made therein without departing from the spirit of the invention as defined by the scope of the appended claims.

What is claimed is:

1. A multipurpose launcher and control comprising:

an elevatable and trainable support structure centrally located on a substantially horizontal platform;

inclined arrays of launchers located sidelong to said elevatable and trainable support structure; and electrical systems to control and monitor said elevatable and trainable support structure and said inclined arrays of launchers.

2. The multipurpose launcher of claim 1 wherein said inclined array of launchers are mounted on a sloping platform integrally joined with said substantially horizontal platform.

3. The multipurpose launcher of claim 1 wherein bundled launchers are mounted on said elevatable and trainable support structure.

4. A multipurpose launcher comprising:

a trainable and elevatable support structure centrally located between two sloping platforms;

an array of different size launchers mounted on said sloping platforms;

bundled launchers mounted on said trainable and elevatable support structure; and electrical systems to control and monitor said trainable and elevatable support structure, said array of different size launchers and said bundled launchers.

5. The multipurpose launcher of claim 4 wherein said electrical systems include a non-contact electromagnetic gap connector to carry power to accepting units.

6. The multipurpose launcher of claim 4 wherein said trainable and elevatable support structure and said array of different size launchers are mounted on a platform having a common base.

7. The multipurpose launcher of claim 4 wherein said array different size launchers are positioned at different angles inclination on said sloping platforms.

* * * * *